United States Patent [19]

Bandel

[11] 4,084,086

[45] Apr. 11, 1978

[54] SOLID FUEL LAMP

[76] Inventor: David Bandel, 612 Meyer La. No. 3, Redondo Beach, Calif. 90278

[21] Appl. No.: 668,721

[22] Filed: Mar. 22, 1976

[51] Int. Cl.[2] ..... F21V 35/00

[52] U.S. Cl. ..... 362/161; 431/290

[58] Field of Search ..... 240/13, 17, 10 B; 431/290, 319, 320

[56] References Cited

U.S. PATENT DOCUMENTS

| | | | |
|---|---|---|---|
| 3,697,739 | 10/1972 | Novak et al. | 240/13 X |
| 3,867,625 | 2/1975 | Whalen | 240/13 |
| 3,873,263 | 3/1975 | DeCroix | 431/290 |
| 3,910,753 | 10/1975 | Lee | 431/290 |

*Primary Examiner*—Richard L. Moses
*Attorney, Agent, or Firm*—Allen A. Dicke, Jr.

[57] ABSTRACT

Solid fuel lamp comprises closed vessel carrying solid fuel with a tubular wick holder extending upward out of the top of the closed vessel. Its lower end extends adjacent the bottom of the vessel. The wick holder is slotted and carries a wick from the region of the fuel to above the top of the vessel. Upon application of a lighting flame to the top of the wick, the fuel in the wick is liquefied and vaporized and burns. The heat from the flame is conducted down the tube and melts the solid fuel in the wick and adjacent the tubular wick holder. A continuous supply of liquid fuel is provided to the wick. The solid fuel cartridge is mounted in a lamp.

5 Claims, 1 Drawing Figure

SOLID FUEL LAMP

BACKGROUND

This invention is directed to a lamp which uses a solid fuel cartridge containing a solid fuel of low melting point (i.e., 80° to 160° F) which fixes the flame at a non-varying point. It combines the safety and handling convenience features of a solid fuel lamp or candle with the advantage of maintaining a fixed and non-varying flame position during its entire burning period. This is a feature of prime importance in the use of candles.

Candles using a wax as fuel and a wick to permit formation of a flame are commonly used for decorative purposes. In many cases, the wax is confined and contained in a glass or similarly appropriate vessel with a wick running through the approximate center. In use, the wick burns down slowly as the wax is consumed, which changes the position of the flame. Some types of construction avoid the change in flame height relative to the container by use of a spring-fed pressure plate to raise the candle to maintain the flame at a fixed height. In normal operation, the wick will maintain its height at a point just above the surface of the wax with the flame melting the wax beneath so that the liquid wax can be wicked to the burning area to maintain the flame. As the wax level drops, the wick burns down to the wax level. Beyond a certain point, the wick is difficult to relight with a hand-held match. In such cases, special tapers and lighting sticks must be used to avoid burning the fingers. It is common to see dropped matches in such candles where an attempt has been made to light the wicks.

There are also liquid fuel lamps. Such lamps have been developed over the ages for the burning of vegetable, animal, or mineral oils. The kerosene lamp is the liquid fuel lamp which had been widely used in recent generations before the broad distribution of electricity. The kerosene lamp has a liquid reservoir for the containment of kerosene and a wick which extends upward out of the reservoir to the place where the flame is held. A guard prevents the flame from traveling down the wick, and the height of adjustment of the wick above the guard controls the amount of available fuel supply and thus the amount of flame. When properly trimmed and adjusted, the wick in a kerosene lamp is not consumed. A major disadvantage of a liquid fuel lamp is the fire danger because, if the liquid is spilled or the reservoir is broken, the liquid fuel spreading in such manner represents a major fire hazard. For this reason, solid fuel is much preferred.

SUMMARY

In order to aid in the understanding of this invention, it can be stated in essentially summary form that it is directed to a solid fuel lamp having a solid fuel replaceable cartridge and a lamp housing. The cartridge is for containing solid fuel. A wick holder extends down into the cartridge reservoir, and a wick is positioned adjacent thereto so that, when the wick is lighted, the wick holder transfers heat down into the solid fuel, melts it, and permits it to rise in the wick.

It is thus an object of this invention to provide a solid fuel lamp which is economic of construction and readily handled to be safe and reliable. It is another object of this invention to provide a solid fuel lamp cartridge. It is another object of this invention to provide a solid fuel lamp which has a wick, with the wick being held in a wick holder which transfers heat from the flame to the solid fuel to melt the fuel and supply liquid fuel to the wick for transport up the wick to fuel the flame. It is a further object of this invention to provide a solid fuel lamp cartridge with a heat transfer device therein with the heat transfer device being structured and positioned so that an adequate amount of heat is supplied to melt a sufficient amount of fuel to permit a smooth burning of the flame.

It is another object of this invention to provide a lamp for containing the solid fuel lamp cartridge to provide a sufficient oxygen supply and exhaust vent for the lamp flame but restrain excessive air movement around the flame to prevent guttering of the flame. Other objects and advantages of this invention will become apparent from a study of the following portion of the specification, the claims, and the attached drawings.

BRIEF DESCRIPTION OF THE DRAWINGS

The single FIGURE of the drawings is a perspective view of the solid fuel lamp of this invention with a portion of the lamp housing being broken away to show the solid fuel lamp cartridge therein and with the cartridge being broken away to show the interior construction thereof.

DESCRIPTION OF THE PREFERRED EMBODIMENT

Figure 1:
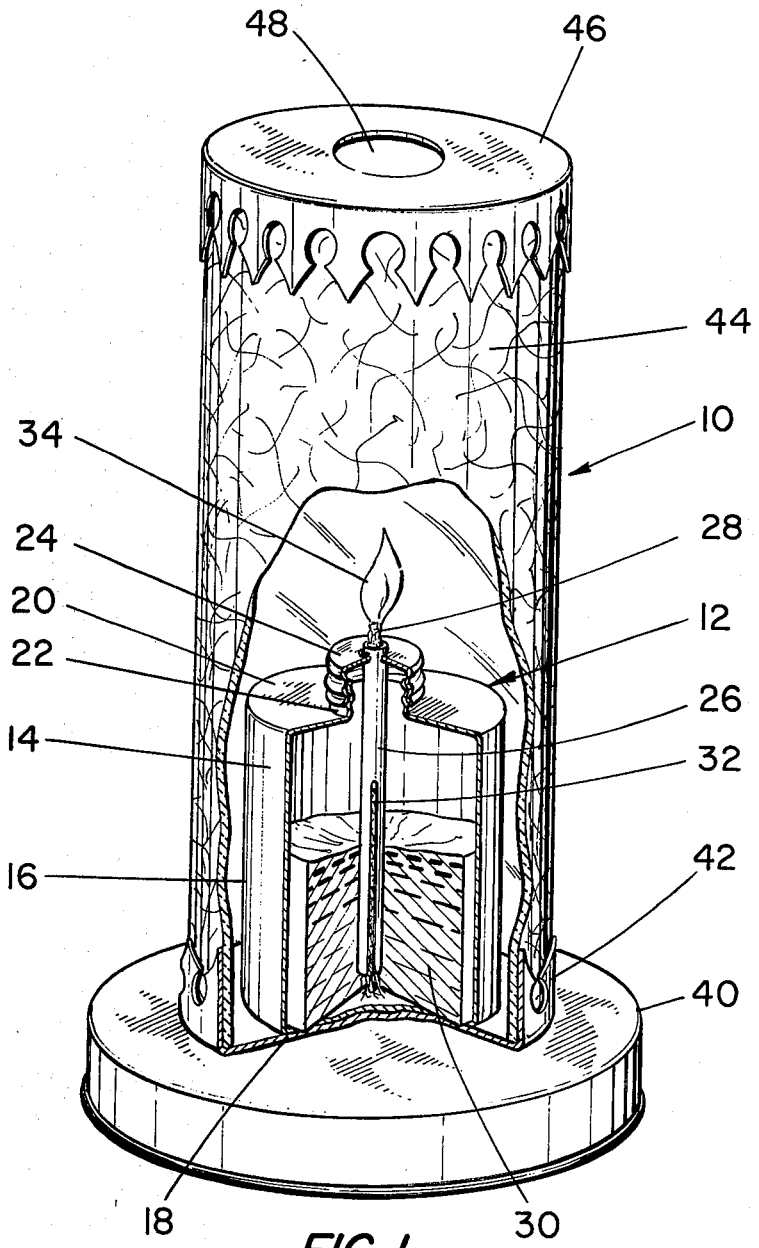

The drawing indicates lamp 10 and lamp cartridge 12 therein. While lamp cartridge 12 is useful in other lamps, lamp 10 is particularly designed for employing lamp cartridge 12. Lamp cartridge 12 comprises reservoir 14 which has a cylindrical shell 16 with closed bottom 18. The upper part of reservoir 14 includes top 20 which has an upwardly extending neck 22. Neck 22 has screwthreads thereon for receiving cap 24 threaded thereon. The preferred reservoir material is metallic so that it cannot be readily broken, as is glass, and metal remains strong at higher temperatures than most polymer composition materials. Other reservoir constructions such as a flat top vessel can be employed.

Cap 24 has an opening therethrough in which is secured tube 26. Tube 26 extends slightly above the top of cap 24 and extends downward into the reservoir and terminates just above the closed bottom 18 of the reservoir. Tube 26 serves a plurality of functions. At the top end, it acts as a flame holder which limits the downward progression of the flame. It acts as the heat conductor by which heat is conducted from the flame downward into the interior of the reservoir and to the fuel in the reservoir. It also acts as a wick holder to hold the wick in position. Furthermore, it aids the wick in its capillary action in bringing liquefied fuel up to the flame position. Wick 28 extends through wick holder tube 26 to extend slightly above the top where the wick supplies fuel to the lamp flame and extends out of the bottom of the tube to the bottom of the reservoir. Wick 28 may be of standard cotton wicking material, but it is preferably of a non-burnable material, such as glass roving, glass braid, asbestos string, or fine strand metal wires.

Fuel 30 is positioned in reservoir 14 and is selected so that its melting point is low enough to form and maintain a pool of molten fuel at the wick with heat from the flame. To aid in permitting the liquid fuel around tube 26 to reach the wick, wick holder tube 26 has a slot 32 therein from adjacent its lower end to the level of the top of the fuel 30 in reservoir 14 when the reservoir is filled. The optimum melting point of the fuel will depend upon the dimensions of the lamp and the fuel container. In general, fuel melting points in the range between 80° and 160° F have been found to work successfully. A preferred melting point range of 90° to 100° F is suitable for lamps with reservoirs of more than four ounces of fuel. By selecting the proper hydrocarbon fraction, the fuel is obtained; however it is preferable to compound the fuel by mixing a fraction of higher (such as paraffin) and a fraction of lower (such as kerosene) melting points in selected proportions to achieve the desired melting point of the compound.

When so arranged and with suitable fuel in the reservoir and in tube 26, lighting of the portion of wick 28 extending out of the top of tube 26 lights flame 34. It burns on fuel which is vaporized from the liquid fuel in the top of wick 28. Flame 34 returns heat through radiation to the top of tube 26 and supplies heat to the solid fuel in the tube and around the tube causing its liquefaction. With liquefaction, it moves upward through wick 28 to continuously supply molten fuel to the top of the wick where it is vaporized and burned in the flame. Downward conduction of heat through tube 26 is continuous when the flame is burning and liquefies the solid fuel 30 around the outside of tube 26. As required, this pool of molten fuel supplies liquid through slot 32 to wick 28 for supply to the flame. The viscosity of fuel 32 is such (coupled with the supply of heat from the flame) that the fuel settles in reservoir 14 so that it is continuously available around the tube. In this way, liquefied fuel 30 is continuously supplied to the wick as long as the flame is burning. When the flame is extinguished, the fuel solidifies around the tube and in the tube all the way to the top of the wick so that it is available for the next lighting cycle. By careful balance of the melting point of the fuel, the size of reservoir 14 and the size of flame 30 as well as the amount of heat tube 26 can conduct downward, continuous supply of liquefied fuel is available to the flame, and the flame burns evenly.

Lamp 10 has a standard 40 on which is mounted cup 42 which receives lamp tube 44. Lamp tube 44 is translucent or colored transparent to act as a diffuser so that flame 34 provides decorative and useful illumination. Lamp cap 46 fits over the top of lamp tube 44 and totally encloses the tube except for vent opening 48 in lamp cap 46. Except for vent opening 48, the entire lamp shell is closed, including the sides of lamp tube 44 and the bottom closure by cup 42. With a one-half to two inch diameter of a round vent opening 48 or equivalent area in other shapes, just enough circulation of exhaust gases from and fresh air into lamp 10 is provided to maintain a steady flame 34. With lamp cap 46 left off, the free circulation of outside air down into the interior of lamp tube 44 caused by the thermal action of flame 34 causes excessive drafts to result in guttering of the lamp flame. In combination with the desired flame size of about three-quarter of an inch high, a three-quarter inch diameter vent opening is the correct size. Less causes oxygen starvation of the flame, while substantially more causes flame guttering. Thus, the lamp works in combination with the lamp cartridge to provide a steady flame.

This invention having been described in its preferred embodiment, it is clear that it is susceptible to numerous modifications and embodiments within the ability of those skilled in the art and without the exercise of the inventive faculty. Accordingly, the scope of the invention is defined by the scope of the following claims.

What is claimed is:

1. A solid fuel lamp cartridge comprising:

a reservoir vessel having closed sides and a closed bottom, said reservoir containing solid fuel, said solid fuel having a melting point between ambient temperature and 160° F;

a closed top on said reservoir, said top being attached to said reservoir sides;

a finless wick holder tube mounted on and extending downwardly through said closed top and extending substantially to the bottom of said reservoir, side openings at least halfway up the length of said wick holder tube for permitting access of molten fuel into said wick holder tube;

said top being penetrated only by said wick holder tube;

a wick extending through said wick holder tube to adjacent the bottom of said reservoir and extending upward out of said wick holder tube to define a flame-holding area, said wick holder tube containing only said wick and flame fuel, said solid fuel having a melting point such that, and said wick holder tube having an internal volume and a thermal transmissivity such that, when the portion of the wick extending above said wick holder has a lighting flame applied thereto, sufficient fuel in the wick is evaporated to permit lighting of an initial flame, and the initial flame provides sufficient heat down through said wick holder to melt the solid fuel in and around said wick holder to smoothly and continuously supply liquid fuel to the top of said wick for a smooth, continuous flame, said reservoir being closed so that all liquid fuel is retained therein when the reservoir is turned on its side even after the flame has been lighted.

2. The solid fuel lamp cartridge of claim 1 wherein said wick is fibreglass.

3. The solid fuel lamp cartridge of claim 1 wherein said solid fuel is formulated with a melting point between ambient room temperature and 160° F by mixing liquid and solid hydrocarbons together in such proportions as to achieve that melting point.

4. The solid fuel lamp cartridge of claim 3 wherein the hydrocarbons are substantially kerosene and paraffin.

5. The solid fuel lamp cartridge of claim 1 wherein said tube has a slot at least partway up its side to provide said opening.

* * * * *